US012364352B2

(12) United States Patent
Lin

(10) Patent No.: US 12,364,352 B2
(45) Date of Patent: Jul. 22, 2025

(54) ROTARY WINE GLASS WITH REFRIGERATION FUNCTION

(71) Applicant: Guopei Lin, Jiangmen (CN)

(72) Inventor: Guopei Lin, Jiangmen (CN)

( * ) Notice: Subject to any disclaimer, the term of this patent is extended or adjusted under 35 U.S.C. 154(b) by 0 days.

(21) Appl. No.: 18/822,857

(22) Filed: Sep. 3, 2024

(65) Prior Publication Data

US 2024/0423396 A1 Dec. 26, 2024

(30) Foreign Application Priority Data

Apr. 29, 2024 (CN) ..... 202420913250.3

(51) Int. Cl.
*F25B 21/02* (2006.01)
*A47G 19/22* (2006.01)

(52) U.S. Cl.
CPC ..... *A47G 19/2288* (2013.01); *A47G 19/2227* (2013.01); *A47G 19/2255* (2013.01); *F25B 21/02* (2013.01); *A47G 2019/2238* (2013.01)

(58) Field of Classification Search
CPC ..... F25D 31/008; F25D 31/002; F25D 2331/808; F25B 21/02; A47G 19/2205; A47G 19/2288; A47G 19/2227; A47G 19/2255; A47G 19/2261; A47G 2019/2238; A47G 23/0216; F03G 5/092; F03G 5/00; H02K 47/00; H02K 47/04; H02K 47/14;

(Continued)

(56) References Cited

U.S. PATENT DOCUMENTS 5,014,865 A * 5/1991 Sauber ..... A47G 19/2255 215/377
11,026,529 B2 * 6/2021 Ferraro ..... A47G 19/2261

(Continued)

FOREIGN PATENT DOCUMENTS

CN 109431208 A * 3/2019 ..... A47G 19/2227
CN 112401607 A * 2/2021 ..... A47G 19/2205

(Continued)

OTHER PUBLICATIONS

KR-20230138730-A English Translation (Year: 2023).*

(Continued)

*Primary Examiner* — Frantz F Jules
*Assistant Examiner* — Devon Moore
(74) *Attorney, Agent, or Firm* — Hemisphere Law, PLLC; Zhigang Ma

(57) ABSTRACT

The present invention discloses a rotary wine glass with a refrigeration function, comprising a base. The top of the base is rotationally connected with a connecting rod, the inner side of the bottom of the connecting rod is provided with a generator, the motor shaft of the generator is connected with the base, the top of the connecting rod is provided with a control circuit board electrically connected with the generator, the control circuit board is provided with a lamp bead emitting light outwards, the top of the connecting rod is connected with an upper connecting socket, the outer side of the upper connecting socket is provided with a plurality of light transmitting holes, the top of the upper connecting socket is connected with a semiconductor chilling plate electrically connected with the control circuit board, and the top of the semiconductor chilling plate is provided with a glass body.

9 Claims, 3 Drawing Sheets

(58) Field of Classification Search
CPC ..... H02K 47/20; H02K 51/00; H02K 53/00; H02K 99/10; H02K 5/00; H02K 7/003; H02K 7/08; H02K 7/14; H02K 2205/00; H02K 2207/00; H02K 2207/03; H02K 2213/00; Y02E 10/20
See application file for complete search history.

(56) References Cited

U.S. PATENT DOCUMENTS

| | | | | |
|---|---|---|---|---|
| 2007/0119726 | A1 | 5/2007 | Willat et al. | |
| 2011/0132910 | A1 | 6/2011 | Willat et al. | |
| 2013/0228585 | A1* | 9/2013 | Solari | A47G 19/2261 220/731 |
| 2014/0027462 | A1 | 1/2014 | Willat et al. | |
| 2024/0011686 | A1* | 1/2024 | Volfson | F25B 49/00 |

FOREIGN PATENT DOCUMENTS

| | | | | |
|---|---|---|---|---|
| KR | 101338004 | B1 * | 1/2014 | A47G 23/16 |
| KR | 20230138730 | A * | 10/2023 | A47G 19/2288 |

OTHER PUBLICATIONS

CN-109431208-A English Translation (Year: 2019).*
KR-101338004-B1 English Translation (Year: 2014).*
CN-112401607-A English Translation (Year: 2021).*

* cited by examiner

ROTARY WINE GLASS WITH REFRIGERATION FUNCTION

TECHNICAL FIELD

The present invention relates to the technical field of wine glasses, and particularly relates to a rotary wine glass with a refrigeration function.

BACKGROUND

Red wine not only can maintain beauty and keep young, but also can promote blood circulation, warm the body and delay aging. Red wine is often drunk in goblets, and needs to be decanted before drinking. A patent for invention with the patent No. of 202321415452.7 discloses a rotary wine glass, which has simple structure and is stable to place, easy to decant and smooth and stable to rotate. The glass body can also be normally placed on the table as an ordinary wine glass, and one wine glass has two purposes, meeting the diverse needs of users. The present invention is convenient to use and provides good experience for consumers. However, with the improvement of living standards of people, the pursuit for the taste of red wine and the visual atmosphere when drinking red wine is also getting higher and higher. A wine glass is required to have functions of refrigeration, lighting decoration and play, but traditional wine glasses do not have functions of automatic luminescence and automatic refrigeration and cannot satisfy the requirements of consumers who pursue high-quality enjoyment, which affects the experience of consumers. Therefore, in order to avoid the defects in the prior art, it is necessary to improve the prior art.

SUMMARY

The purpose of the present invention is to overcome the defects and deficiencies in the prior art and provide a rotary wine glass with a refrigeration function having simple structure and convenient use.

The present invention is realized by the following technical solution:

A rotary wine glass with a refrigeration function, comprising a base, wherein the top of the base is rotationally connected with a connecting rod, the inner side of the bottom of the connecting rod is provided with a generator, the motor shaft of the generator is connected with the base, the top of the connecting rod is provided with a control circuit board electrically connected with the generator, the control circuit board is provided with a lamp bead emitting light outwards, the top of the connecting rod is connected with an upper connecting socket, the outer side of the upper connecting socket is provided with a plurality of light transmitting holes, the top of the upper connecting socket is connected with a semiconductor chilling plate electrically connected with the control circuit board, and the top of the semiconductor chilling plate is provided with a glass body.

Further, the bottom of the semiconductor chilling plate is provided with a switch electrically connected with the control circuit board.

Further, the upper part of the glass body is gradually reduced from bottom to top.

Further, the bottom of the base is provided with a plurality of suckers, and the bottom of the base is provided with positioning and mounting holes for positioning and installing the suckers.

Further, the bottom of the connecting rod is screwed with a lower connecting socket, the bottom of the connecting rod is provided with a lower stud, the top of the lower connecting socket is provided with an internal threaded hole of the lower connecting socket corresponding to the lower stud, the upper part of the base is provided with a plurality of bearings, the bottom of the lower connecting socket is provided with a connecting stud, and the inner race of each bearing is provided with an internal thread corresponding to the connecting stud.

Further, the lower part of the base is provided with a motor shaft mounting hole for fixing and installing the motor shaft of the generator.

Further, the inner part of the connecting rod is hollow, and the top of the connecting rod is provided with a mounting groove for installing the control circuit board.

Further, the semiconductor chilling plate is wrapped on the outer side of the lower part of the glass body, and the outer side of the lower part of the glass body is provided with a positioning and mounting platform for installing the semiconductor chilling plate.

Further, the inner side of the upper connecting socket is provided with an internal threaded hole of the upper connecting socket, and the top of the connecting rod is provided with an upper stud corresponding to the internal threaded hole of the upper connecting socket.

Further, each light transmitting hole is provided with a transparent decorating part.

Compared with the prior art, the rotary wine glass of the present invention has simple structure and has the functions of automatic luminescence, automatic refrigeration and play by the structure that the top of the base is rotationally connected with the connecting rod, the motor shaft of the generator is connected with the base, the top of the connecting rod is provided with the control circuit board electrically connected with the generator, the control circuit board is provided with the lamp bead emitting light outwards, the outer side of the upper connecting socket is provided with a plurality of light transmitting holes, the top of the upper connecting socket is connected with the semiconductor chilling plate electrically connected with the control circuit board, and the top of the semiconductor chilling plate is provided with the glass body; in use, the base is held by hand, then the connecting rod is rotated, at the same time that the connecting rod, the upper connecting socket and the semiconductor chilling plate are rotated together with the glass body for decanting, the generator automatically generates electricity to supply the semiconductor chilling plate and the lamp bead of the control circuit board, and the semiconductor chilling plate cools wine in the glass body, which improves the taste of the wine; the light emitted by the lamp bead is transmitted to the outside world through the light transmitting holes, thus providing good lighting decoration effect and good visual atmosphere; and consumers have fun while spinning wine glasses, which satisfies the requirements of consumers who pursue high-quality enjoyment and provides good experience for consumers.

DESCRIPTION OF DRAWINGS

To more clearly describe the technical solutions in the embodiments of the present invention or in the prior art, the drawings required to be used in the description of the embodiments or the prior art will be simply presented below. Obviously, the drawings in the following description are merely some embodiments of the present invention, and for those ordinary skilled in the art, other drawings can also be obtained according to the drawings without contributing creative labor.

In the figures: 1-base; 2-connecting rod; 3-generator; 4-control circuit board; 5-lamp bead; 6-upper connecting socket; 7-light transmitting hole; 8-semiconductor chilling plate; 9-glass body; 10-switch; 11-sucker; 12-position and mounting hole; 13-lower connecting socket; 14-bearing; 15-connecting stud; 16-internal thread; 17-motor shaft mounting hole; 18-mounting groove; 19-position and mounting platform; 20-internal threaded hole of upper connecting socket; 21-upper stud; 22-transparent decorating part; 23-lower stud; 24-internal threaded hole of lower connecting socket.

DETAILED DESCRIPTION

The technical solution in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

Figure 1:
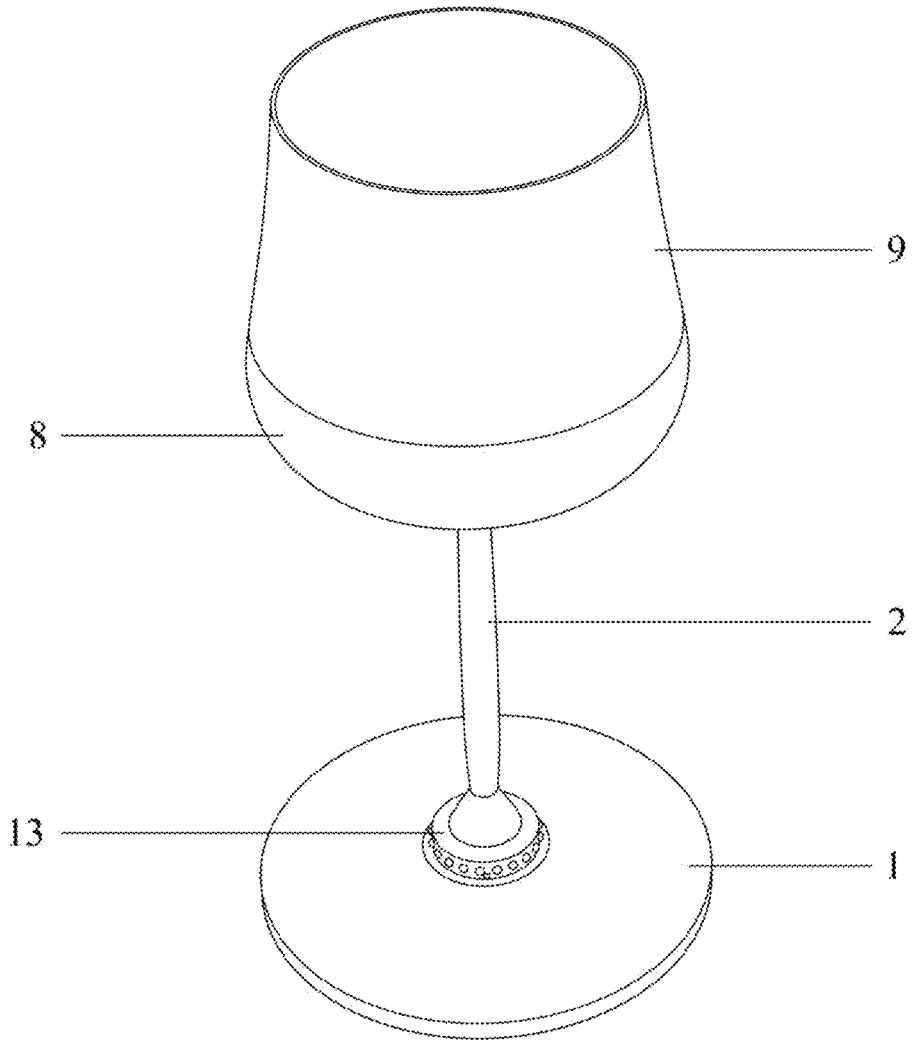
FIG. 1 is a structural schematic diagram of a rotary wine glass with a refrigeration function of the present invention.
Figure 2:
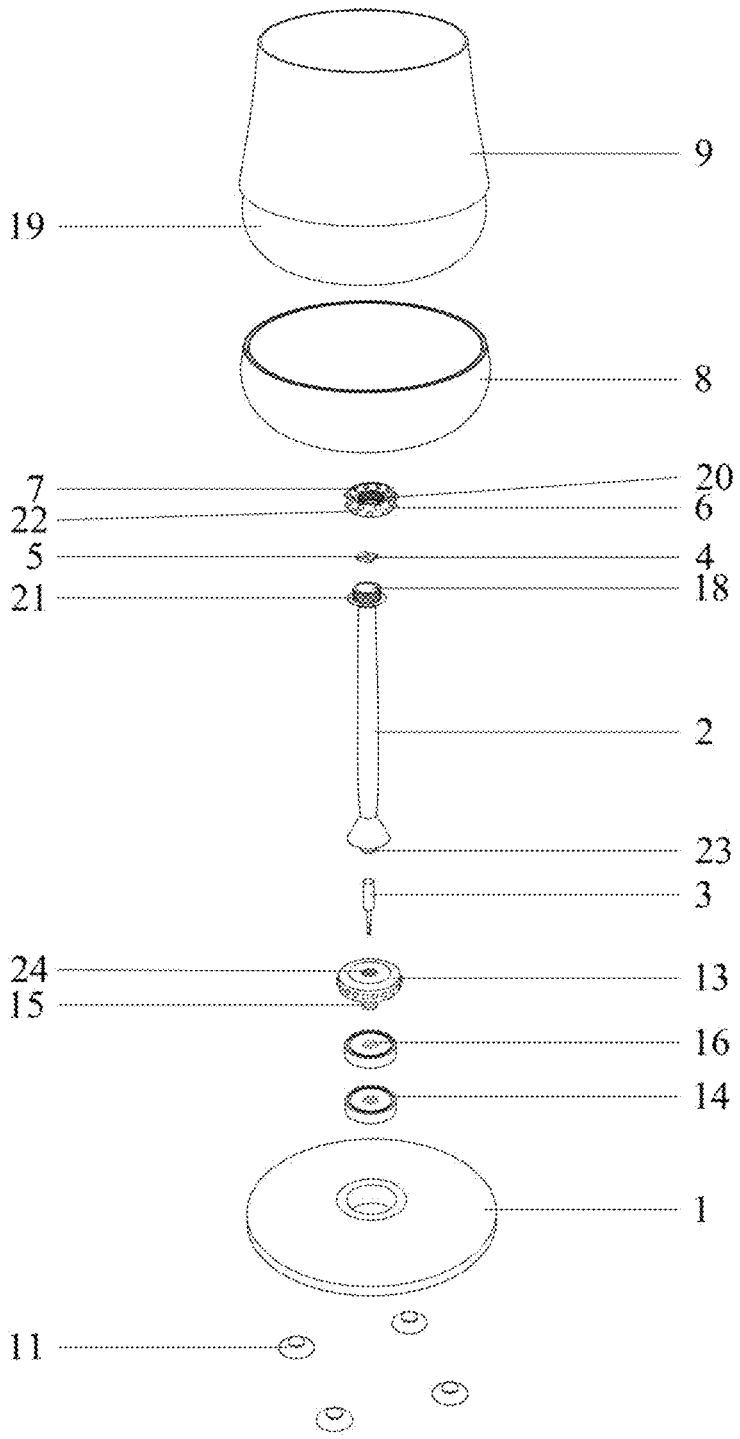
FIG. 2 is a structural exploded diagram of a rotary wine glass with a refrigeration function of the present invention in a first direction.
Figure 3:
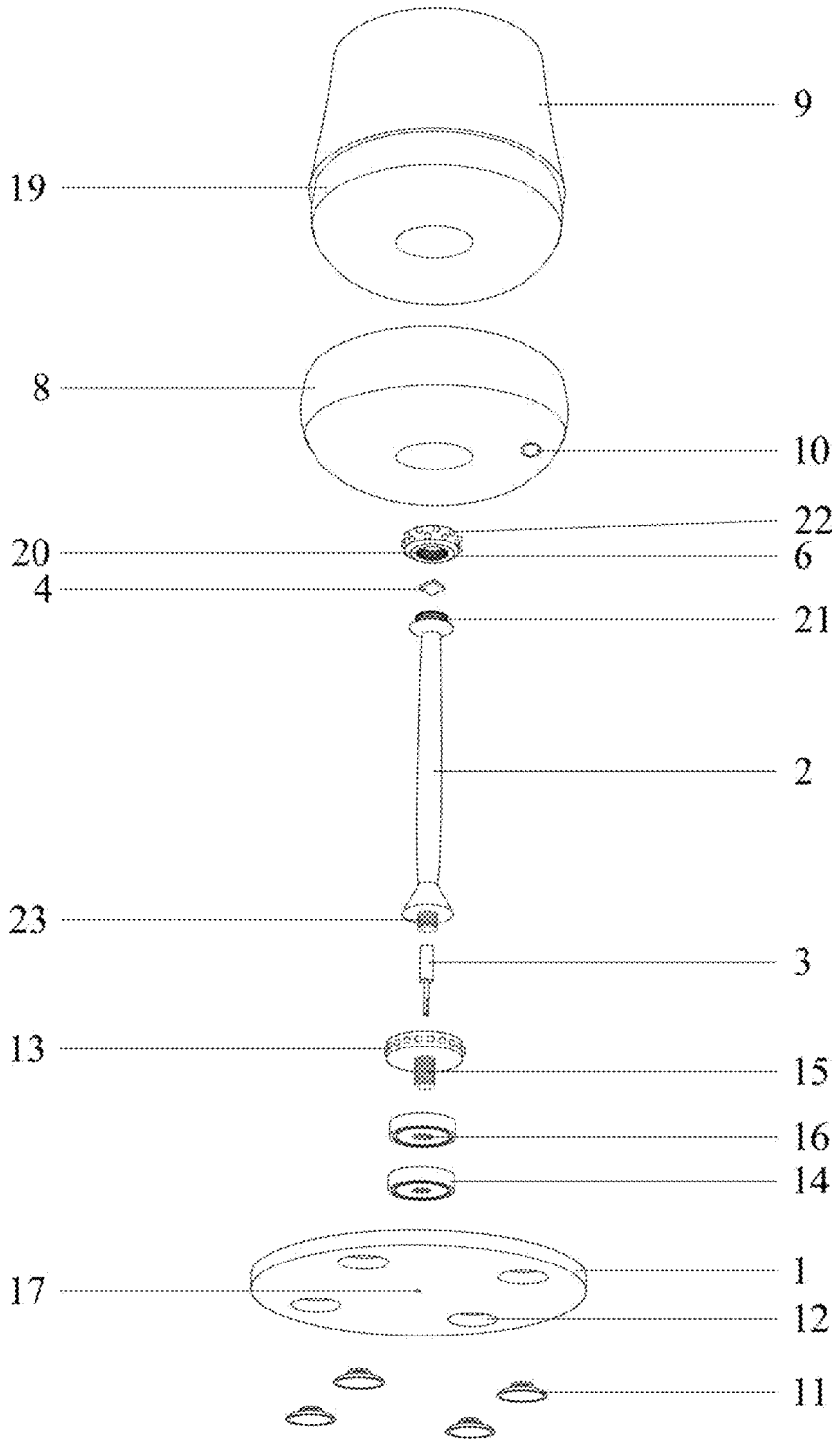
FIG. 3 is a structural exploded diagram of a rotary wine glass with a refrigeration function of the present invention in a second direction.

A rotary wine glass with a refrigeration function of the present invention as shown in FIG. 1 to FIG. 3 comprises a base 1, wherein the top of the base 1 is rotationally connected with a connecting rod 2, the inner side of the bottom of the connecting rod 2 is provided with a generator 3, the motor shaft of the generator 3 is connected with the base 1, the top of the connecting rod 2 is provided with a control circuit board 4 electrically connected with the generator 3, the control circuit board 4 is provided with a lamp bead 5 emitting light outwards, the top of the connecting rod 2 is connected with an upper connecting socket 6, the outer side of the upper connecting socket 6 is provided with a plurality of light transmitting holes 7, the top of the upper connecting socket 6 is connected with a semiconductor chilling plate 8 electrically connected with the control circuit board 4, and the top of the semiconductor chilling plate 8 is provided with a glass body 9. The top of the base 1 is rotationally connected with the connecting rod 2, the motor shaft of the generator 3 is connected with the base 1, the top of the connecting rod 2 is provided with the control circuit board 4 electrically connected with the generator 3, the control circuit board 4 is provided with the lamp bead 5 emitting light outwards, the outer side of the upper connecting socket 6 is provided with a plurality of light transmitting holes 7, the top of the upper connecting socket 6 is connected with the semiconductor chilling plate 8 electrically connected with the control circuit board 4, and the top of the semiconductor chilling plate 8 is provided with the glass body 9 so that the rotary wine glass has simple structure and has the functions of automatic luminescence, automatic refrigeration and play; in use, the base is held by hand, then the connecting rod 2 is rotated, at the same time that the connecting rod 2, the upper connecting socket 6 and the semiconductor chilling plate 8 are rotated together with the glass body 9 for decanting, the generator 3 automatically generates electricity to supply the semiconductor chilling plate 8 and the lamp bead 5 of the control circuit board 4, and the semiconductor chilling plate 8 cools wine in the glass body 9, which improves the taste of the wine; the light emitted by the lamp bead 5 is transmitted to the outside world through the light transmitting holes 7, thus providing good lighting decoration effect and good visual atmosphere; and consumers have fun while spinning wine glasses, which satisfies the requirements of consumers who pursue high-quality enjoyment and provides good experience for consumers.

The bottom of the semiconductor chilling plate 8 is provided with a switch 10 electrically connected with the control circuit board 4, which is convenient for on-off control of the semiconductor chilling plate 8. When not required, the refrigeration function is turned off through the switch 10.

The upper part of the glass body 9 is gradually reduced from bottom to top. Due to the role of the centrifugal force, when the wine glass is rotated for play, the wine will not get out of the wine glass even if the wine glass is placed upside down, improving the play effect of the wine glass.

The bottom of the base 1 is provided with a plurality of suckers 11, and the bottom of the base 1 is provided with positioning and mounting holes 12 for positioning and installing the suckers 11 so that the wine glass can be placed more stably, and when the connecting rod 2 is rotated, the wine glass will not sway, improving the decanting effect.

The bottom of the connecting rod 2 is screwed with a lower connecting socket 13, the bottom of the connecting rod 2 is provided with a lower stud 23, the top of the lower connecting socket 13 is provided with an internal threaded hole 24 of the lower connecting socket corresponding to the lower stud 23, the upper part of the base 1 is provided with a plurality of bearings 14, the bottom of the lower connecting socket 13 is provided with a connecting stud 15, and the inner race of each bearing 14 is provided with an internal thread 16 corresponding to the connecting stud 15 so that the connecting rod 2 can be installed and connected more conveniently and more stably, and the connecting rod 2 is rotated more smoothly, improving the decanting effect.

The lower part of the base 1 is provided with a motor shaft mounting hole 17 for fixing and installing the motor shaft of the generator 3, which is convenient for aligned installation and fixed installation of the motor shaft of the generator 3 and can prevent the stator connected with the motor shaft of the generator 3 from rotating, making power generation more stable.

The inner part of the connecting rod 2 is hollow, and the top of the connecting rod 2 is provided with a mounting groove 18 for installing the control circuit board 4, which is convenient for installation of the control circuit board 4. In specific implementation, a rechargeable battery electrically connected with the control circuit board 4 can be installed in the mounting groove 18 to continuously supply power to the semiconductor chilling plate 8 or the lamp bead 5, improving the lighting decoration effect and the refrigeration effect.

In use, the motor shaft of the generator 3 is connected with the stator without rotation, and the rotor in the generator 3 rotates with the generator casing housing to generate electrical energy to supply the lamp bead 5 and the semiconductor chilling plate 8.

The semiconductor chilling plate 8 is wrapped on the outer side of the lower part of the glass body 9, and the outer side of the lower part of the glass body 9 is provided with a positioning and mounting platform 19 for installing the semiconductor chilling plate 8 so that the semiconductor chilling plate 8 is in close contact with the lower part of the glass body 9, improving the installation stability of the glass body and the refrigeration effect.

The inner side of the upper connecting socket 6 is provided with an internal threaded hole 20 of the upper connecting socket, and the top of the connecting rod 2 is provided with an upper stud 21 corresponding to the internal threaded hole of the upper connecting socket 6 so that the upper connecting socket 6 and the connecting rod 2 can be connected rapidly, conveniently and stably.

Each light transmitting hole 7 is provided with a transparent decorating part 22, improving the lighting decoration effect and making the appearance of the rotary wine glass more beautiful.

The inner wall of the glass body 9 is provided with capacity scale lines, which is convenient for users to know the amount of wine in the glass body 9 and improves the use effect.

The control circuit board 4 is provided with a wireless communication module, which is convenient for on-off control of the lamp bead 5 and the semiconductor chilling plate 8 through APP.

The bottom of the semiconductor chilling plate 8 is provided with a light switch electrically connected with the control circuit board 4, which is convenient for on-off control of the lamp bead 5. When the function of lighting decoration is not required, the luminescence function is turned off through the light switch.

The above is just a preferred embodiment of the present invention and is not intended to limit the present invention. Any modification, equivalent replacement, improvement, etc. made within the spirit and the principle of the present invention shall be contained within the protection scope of the present invention.

The invention claimed is:

1. A rotary wine glass with a refrigeration function, comprising a base, wherein a top of the base is rotationally connected with a connecting rod, an inner side of a bottom of the connecting rod is provided with a generator, a motor shaft of the generator is fixedly connected with the base, a top of the connecting rod is provided with a control circuit board electrically connected with the generator, the control circuit board is provided with a lamp bead emitting light outwards, the top of the connecting rod is connected with an upper connecting socket, an outer side of the upper connecting socket is provided with a plurality of light transmitting holes, a top of the upper connecting socket is connected with a semiconductor chilling plate electrically connected with the control circuit board, and a top of the semiconductor chilling plate is provided with a glass body;

wherein the connecting rod is configured to rotate under an external force to bring the semiconductor chilling plate together with the glass body to rotate; the motor shaft of the generator is fixedly connected to the base without rotation, and a housing of the generator is configured to rotate relative to the motor shaft along with rotation of the connecting rod to allow the generator to generate electrical energy to supply to the lamp bead and the semiconductor chilling plate.

2. The rotary wine glass with a refrigeration function according to claim 1, wherein a bottom of the semiconductor chilling plate is provided with a switch electrically connected with the control circuit board.

3. The rotary wine glass with a refrigeration function according to claim 1, wherein an upper part of the glass body is gradually-reduced from a bottom of the glass body to a top of the glass body.

4. The rotary wine glass with a refrigeration function according to claim 1, wherein a bottom of the base is provided with a plurality of suckers, and the bottom of the base is provided with positioning and mounting holes for positioning and installing the suckers.

5. The rotary wine glass with a refrigeration function according to claim 1, wherein the bottom of the connecting rod is screwed with a lower connecting socket, the bottom of the connecting rod is provided with a lower stud, a top of the lower connecting socket is provided with an internal threaded hole of the lower connecting socket corresponding to the lower stud, an upper part of the base is provided with a plurality of bearings, a bottom of the lower connecting socket is provided with a connecting stud, and an inner race of each bearing is provided with an internal thread corresponding to the connecting stud.

6. The rotary wine glass with a refrigeration function according to claim 1, wherein a lower part of the base is provided with a motor shaft mounting hole for fixing and installing the motor shaft of the generator.

7. The rotary wine glass with a refrigeration function according to claim 1, wherein an inner part of the connecting rod is hollow, and the top of the connecting rod is provided with a mounting groove for installing the control circuit board.

8. The rotary wine glass with a refrigeration function according to claim 1, wherein the semiconductor chilling plate is wrapped on an outer side of a lower part of the glass body, and the outer side of the lower part of the glass body is provided with a positioning and mounting platform for installing the semiconductor chilling plate.

9. The rotary wine glass with a refrigeration function according to claim 1, wherein an inner side of the upper connecting socket is provided with an internal threaded hole of the upper connecting socket, and the top of the connecting rod is provided with an upper stud corresponding to the internal threaded hole of the upper connecting socket.

* * * * *